US005870914A

United States Patent [19]

Dawson

[11] Patent Number: 5,870,914

[45] Date of Patent: Feb. 16, 1999

[54] ELECTRONIC COMBINATION LOCK WITH SELF-CONTAINED POWER GENERATION

[75] Inventor: Gerald Lee Dawson, Lexington, Ky.

[73] Assignee: Mas-Hamilton Group, Lexington, Ky.

[21] Appl. No.: 851,523

[22] Filed: May 7, 1997

Related U.S. Application Data

[60] Provisional application No. 60/019,662 Jun. 12, 1996.

[51] Int. Cl.[6] ..... E05B 49/00

[52] U.S. Cl. ..... 70/278; 70/276; 70/333 R; 70/303 A; 340/825.31

[58] Field of Search ..... 70/303 A, 303 R, 70/333 R, 276, 278; 340/825.31–825.34

[56] References Cited

U.S. PATENT DOCUMENTS

| | | | |
|---|---|---|---|
| 4,745,784 | 5/1988 | Gartner | 70/303 X |
| 4,967,577 | 11/1990 | Gartner et al. | 70/303 X |
| 5,487,290 | 1/1996 | Miller et al. | 70/303 A |
| 5,640,862 | 6/1997 | Remenicky | 70/333 R |

*Primary Examiner*—Suzanne Dino Barrett
*Attorney, Agent, or Firm*—Frost & Jacobs LLP

[57] ABSTRACT

A self-powered lock incorporates a generator within the dial housing. The generator incorporates a plurality of coils and two concentric rings of magnetic segments. The rings are mounted on a dial housing, capable of rotation, and rotation of the dial housing generates operating power for the lock. Dial rotation rotates another ring of magnetic segments to input data necessary for lock operation.

7 Claims, 4 Drawing Sheets

ELECTRONIC COMBINATION LOCK WITH SELF-CONTAINED POWER GENERATION

This application claims priority from U.S. provisional patent application Ser. No. 60/019,662 filed Jun. 12, 1996.

FIELD OF THE INVENTION

This invention relates to self-powered locks and more specifically to locks having within the lock either power generation or a power generator incorporated within the lock for manual operation by the operator prior to attempted opening of the lock.

BACKGROUND OF THE INVENTION

An example of an electronic combination lock which is self-powered or has self-generated power is U.S. Pat. No. 5,061,923 issued to Miller et. al. The Miller patent discloses a stepper motor as a generator to create the electrical power for the lock.

The Mas-Hamilton Group X-07 Lock, the Mas-Hamilton Group Cencon, and Auditcon Locks, all available from the Mas-Hamilton Group, Lexington, Ky., each have stepper motors driven as generators to provide self-contained powering capability.

Other patents which disclose self-powered dial combination locks incorporating generators include U.S. Pat. No. 5,170,431 to Gerald L. Dawson, et.al.; U.S. Pat. No. 5,410,301 to Gerald L. Dawson, et.al.; U.S. Pat. No. 5,493,279 to Gerald L. Dawson, et.al.; U.S. Pat. No. 5,488,358 to James E. Hamilton, et. al.; and U.S. Pat. No. 5,488,660 to Gerald L. Dawson, et. al., all assigned to Mas-Hamilton Group, Lexington, Ky. U.S. Pat. No. 5,265,452 to Gerald L. Dawson, et. al., discloses a keyed cylinder electronic lock with a self-contained generator.

Generation of electrical power depends on the relative movement of a coil through a magnetic field. The more times a coil or coils are passed through a magnetic field or fields, the greater the power generated for any particular time span.

Due to the limited number of coils and magnetic segments or fields of the armature, the power requirement of a lock such as the X-07 or Cencon dictates a step-up drive in order to derive sufficient rotation and, therefore, power from the stepper motor generator. The stepper motors of the Miller U.S. Pat. No. 5,061,923 patent and the Mas-Hamilton Group locks, identified above, further use the stepper motor output as pulse signals for input and control of the microprocessor in the lock electronics.

The step-up drive required to increase the generator output of the stepper motor requires considerable force and stronger components. The stepped up stepper motor drive requires more moving parts than a direct drive, and may result in an increase of mechanical failures, adversely affecting reliability.

The increased forces required to rotate the dial of a lock having a stepped-up drive result both in a degradation of the dial control as well as an operator perception that the dial is difficult to operate.

In locks wherever combinations and commands are entered through a keyboard, the necessity to securely contain and maintain the combination entry signal source within the lock case, inside the secure container, is eliminated because the generator does not supply the data input signals.

In locks using a generator for data input signals, the generator may be used for power and data. Thus, in those instances, it is desirable to maintain the power generator or stepper motor within the lock casing as it will then be disposed within the secure container as well as within the casing itself which will reduce the ability to electronically detect the signals being generated by the lock during combination entry.

OBJECTS OF THE INVENTION

An object of the invention is to simplify the structure of the lock with regard to the power generation function.

It is another object of the invention to reduce the forces required of the operator to generate operational power in the lock.

It is a further object of the invention to improve the reliability of the lock through simplification of the power generating apparatus.

It is a still further object of the invention to reduce the effort necessary for precise manipulation of the dial for control of the lock in those lock environments wherever the data is entered by the dial.

It is an additional object of the invention to provide a separate data entry through magnetic response to a dial rotation.

It is still another objective of the invention to provide more space in the lock casing by eliminating any requirement that the stepper motor be included within the lock casing.

SUMMARY OF THE INVENTION

A generator is housed within the dial/dial ring assembly of an electronic combination lock to generate the electrical power necessary for operating the electronic components of the electronic combination lock. The generator may be used in an alternative form of a lock having a data input such as a keypad or a key input for transferring data from the operator to the electronic controls of the lock.

The generator may be fabricated of a plurality of wire coils attached to a circuit board. The circuit board is located within the dial ring and behind the dial of an electronic combination lock. A rotatable dial of the lock is coaxially located with the dial ring and is provided with a ring magnet assembly of two rings of magnets creating magnetic fields which intersect the coils mounted on the circuit board.

The moving magnetic fields interacting with the coils generate the voltage and current to power the lock. With the magnetic ring mounted on the dial, the magnetic force fields can be moved past the coils at a sufficient speed to generate the required voltage. A relatively large number of magnet segments may be used in fabricating the magnet rings and thus effect a large number of flux field changes and, hence, magnetic interactions with the coil for any amount of rotation in order to generate the power for lock operation. A separate dial may be used for driving a magnetic disc past a plurality of magnetically responsive switches or detectors for entry of data if a keypad or keyboard is not used.

A more complete understanding of the invention may be had from the attached drawings and the detailed description to follow.

DETAILED DESCRIPTION OF THE INVENTION

The following is a detailed description of the best mode of the preferred embodiment of the invention as contemplated by the inventor.

Figure 1:
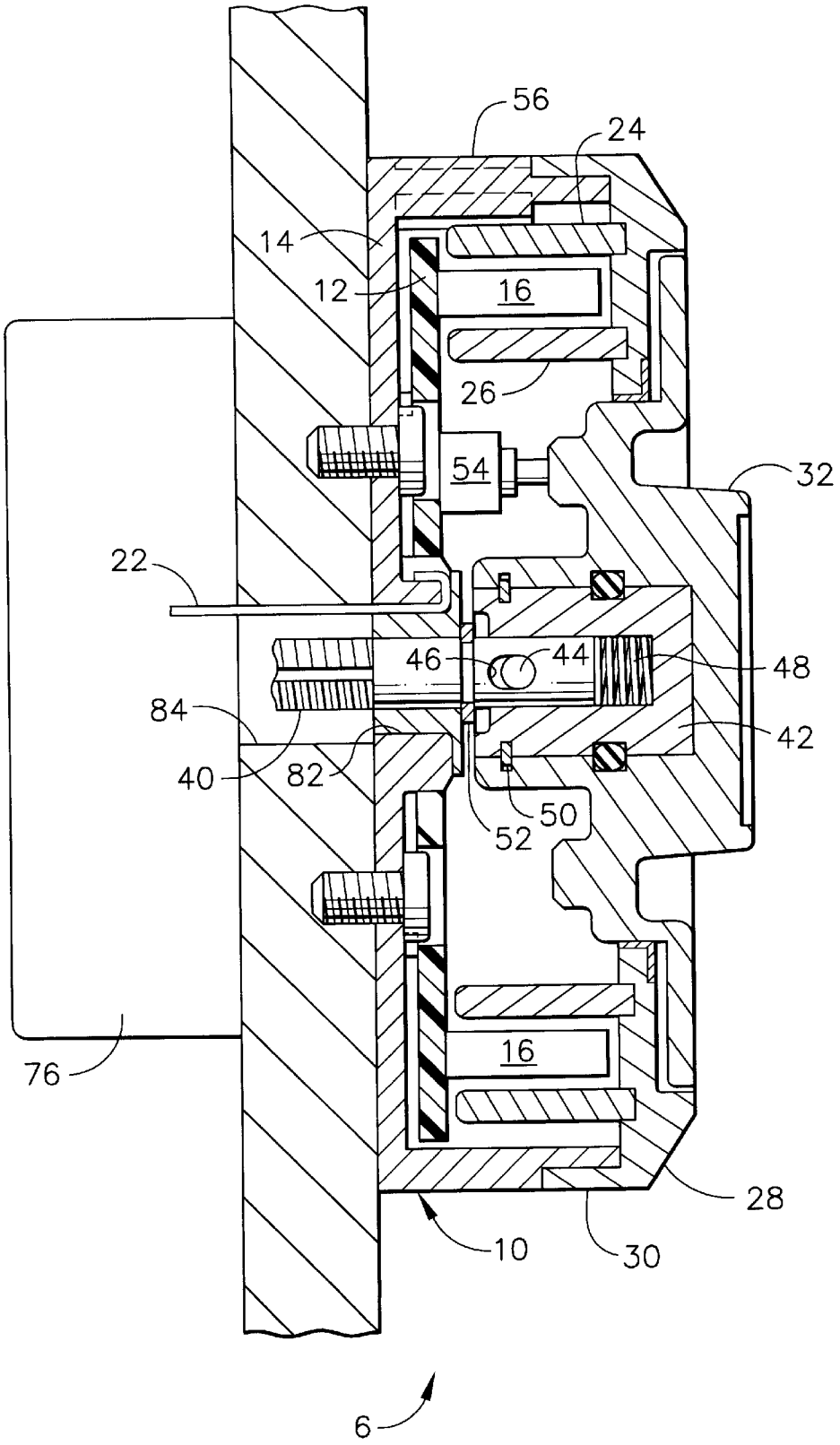
FIG. 1 is a sectional view of the dial, dial ring housing and generator of the electronic combination lock.
Figure 2:
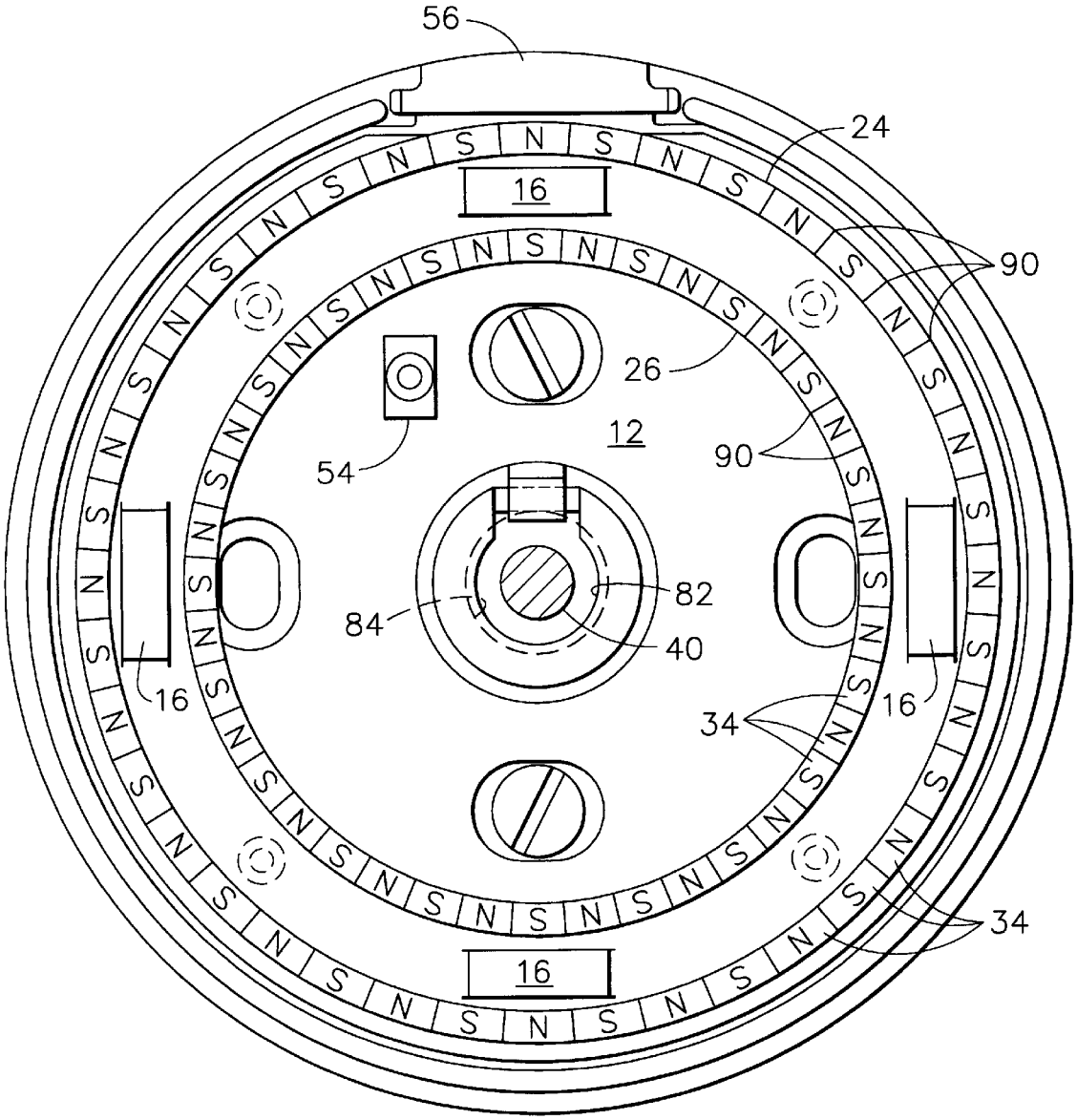
FIG. 2 is a plan view of the dial ring housing with the magnetic ring disposed in operating relationship to the coils.
Figure 3:
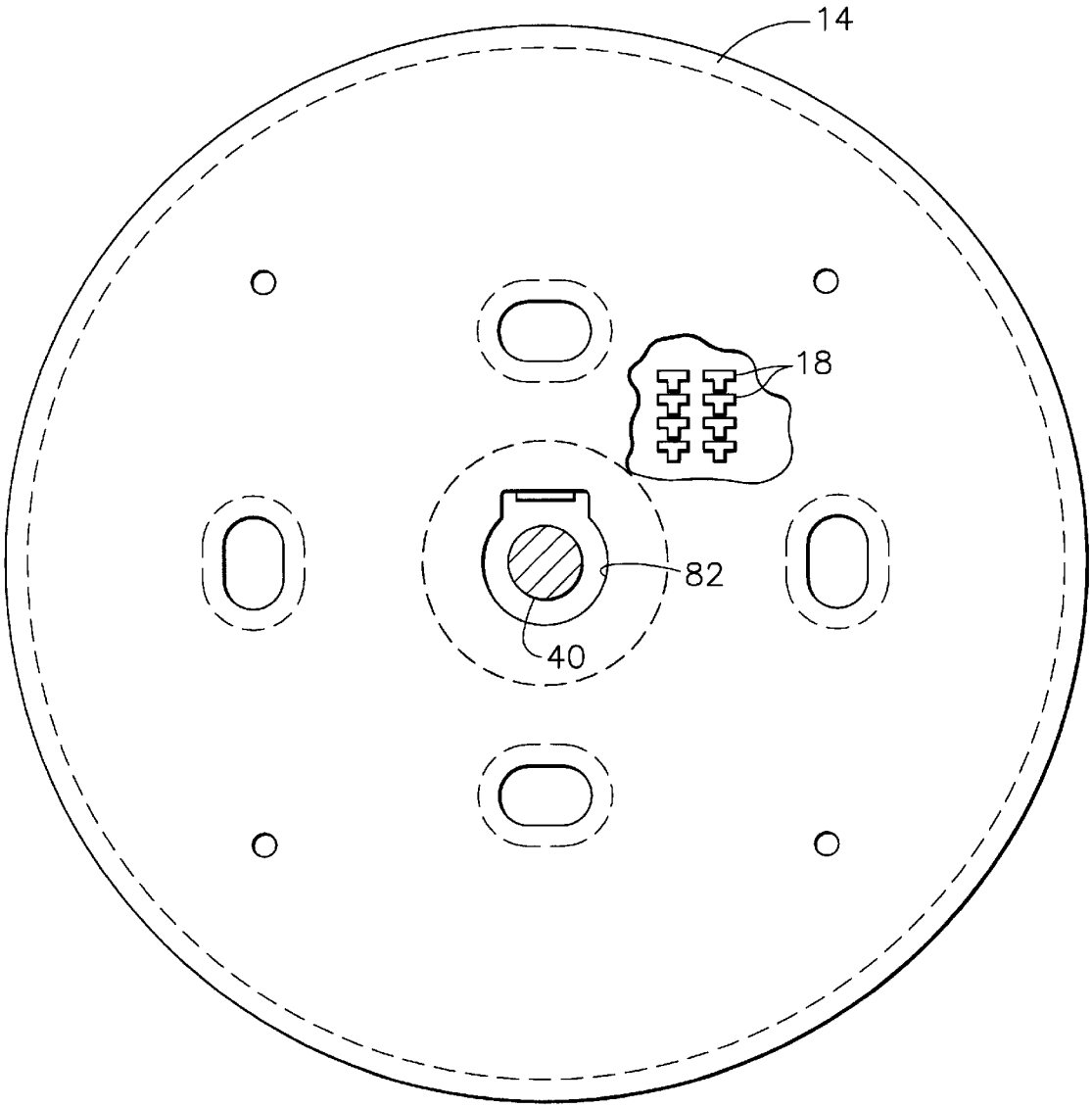
FIG. 3 illustrates the backside of the dial ring with the rectifier circuit location shown.

Referring now to FIG. 1 and supplementary to FIGS. 2–5, there is shown a dial ring 10 of an electronic lock 6 with a dial ring printed circuit card 12 mounted inside the dial ring 10. Mounted in a conventional manner to the dial ring printed circuit card 12 are coils of wire 16, in this instance four coils of wire 16. The wire coils 16, in turn, are wired to the full wave rectifier circuit 18 illustrated in FIG. 3, and showing the reverse side of the dial ring 10.

Figure 5:
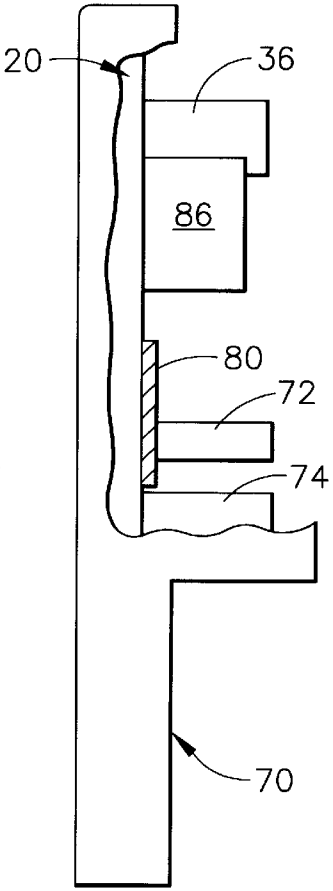
FIG. 5 illustrates a side view of the back cover and electronic control circuit board of the electronic combination lock.

The output of the rectifier circuit 18 flows to the electronic controls on circuit card 20 shown in FIG. 5 through cable 22 routed from the dial ring 10 via tubes 82 and 84.

FIG. 1 shows the magnet ring 24, 26 arrangement on outer dial 28 with an outer circular magnet ring 24 and an inner circular magnet ring 26. Each magnet ring 24 and 26 is formed of alternating polarity magnetic segments 34 with the south poles of the inner magnet ring 26 aligned with the north poles of the outer magnet ring 24, thus creating an alternating magnetic flux field between the outer and inner magnet rows 24, 26 as best observed in FIG. 2.

Referring to FIG. 1, the outer dial 28 is mounted on the dial ring 10 by the hub flange 30 of the dial ring 10 and captured by the inner dial 32. The magnet rings 24, 26 may be magnetic segments 34 either separated by non-magnetic spacers 90, or assembled from alternating orientation magnetic segments 34.

Whenever the outer dial 28 is rotated in either direction by the operator, the inner and outer magnet rows 26, 24 mounted on the outer dial 28 will similarly rotate and create a rotating alternating flux field. This flux field will cut across coils 16 mounted on the dial ring printed circuit card 12 mounted to the dial ring 10, thereby generating an alternating current voltage and supplying the AC voltage to the rectifier circuit 18. The output of the rectifier circuit 18 is conveyed to the lock electronic controls over cable 22, wherein an electrical charge is stored in a super capacitor 86 or a very large capacitance capacitor 86 on the electronic controls circuit card assembly 20 in FIG. 5.

Figure 4:
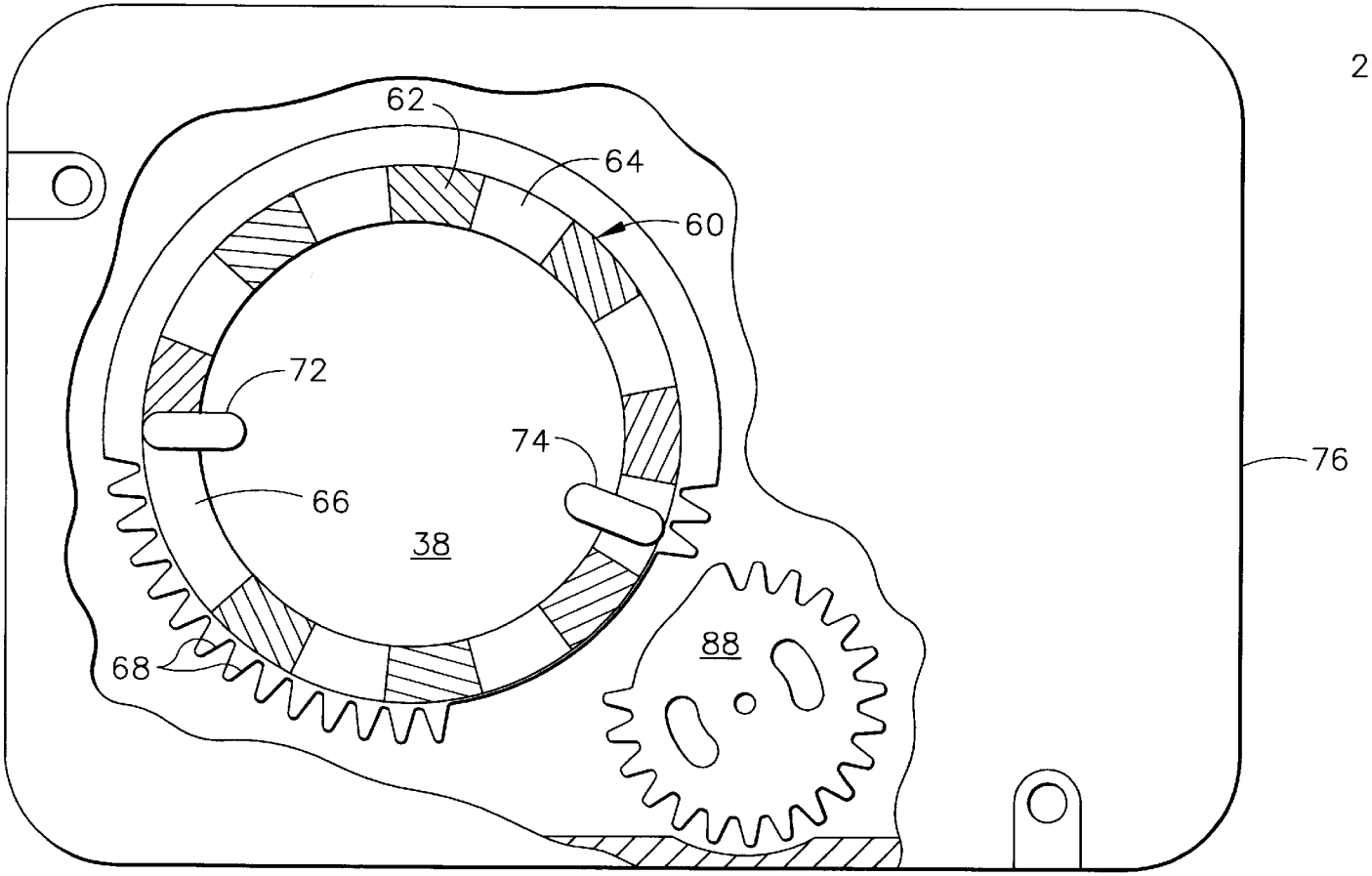
FIG. 4 illustrates the lock casing with the back plate broken away to expose the cam wheel and stepper motor of the mechanical drive of the lock.

Drive cam assembly 38, observable in FIG. 4, is fixedly attached to and rotated by spindle 40 which, in turn, is attached to the inner dial hub 42 threaded pin 44 screwed into inner dial hub 42 and through slot 46 in spindle 40. Spindle 40 is spring loaded outwardly from dial hub 42 by spring 48. The inner dial 32 is attached to the hub 42 by means of an expansion ring 50. Axial motion of the inner dial hub 42 towards the dial ring 10 is restricted by spindle C-clip 52. This assembly permits rotational as well as axial movement of the inner dial 32.

Also mounted to the dial ring printed circuit card 12 is a switch 54 to be activated whenever the spring loaded inner dial 32 is pushed toward the dial ring 10 to create a signal or electrical pulse. This electrical pulse is used by microprocessor 80 as a command to register the number currently displayed on the liquid crystal display 56, as a part of the combination.

FIG. 1 also shows the inner dial 32/inner dial hub 42 assembly attached to the spindle 40 which is, in turn, attached to the drive cam assembly 38. As shown in FIG. 4, on the face of drive cam assembly 38 is a circular flat ring magnet 60 magnetized with alternating magnetic segments 62 and non-magnetic segments 64 or a series of small magnets attached to the drive cam assembly 38 with spaces or spacers. One of the non-magnetic segments or spaces 66 is wider than the others.

Referring to FIG. 5, the printed circuit card assembly 20 is disposed within the lock case back cover assembly 70. Mounted to the printed circuit card assembly 20 are two magnetically actuated form B reed switches 72 and 74 or other magnetically actuated switching devices, such as Hall Effect or Giant Magneto-resistive (GMR) devices. GMR devices are solid state devices which change resistance in response to the presence of a magnetic field. The magnetic devices are accurately offset from each other by 160 degrees. One contact of each magnetically responsive detection device or switch 72, 74 is wired to electrical ground and the other contact of each switch 72, 74 is wired to a port on the lock microprocessor 80. When the drive cam assembly 38 is rotated by turning the inner dial assembly 32 in the clockwise or counterclockwise direction, the face of the circular flat magnet 60 is rotated past magnetically responsive switches 72 and 74. This will cause the devices 72, 74 to transfer to ground when the contacts are made by the magnetic field of segments 62 passing by the switches 72, 74 and open when the nonmagnetic segments 64 pass by the switches 72, 74, thus, generating pulses from each of the magnetically responsive switches 74 and 72, as the segments 62, 64 passes. When the wider or longer, nonmagnetic segment or space 66 passes the reed switches 72, 74, this segment 66 is used to determine direction of rotation of the drive cam assembly 38. This is accomplished by detecting the wide segment 66 first passing the switch 72, and then switch 74, going in the clockwise direction; and the opposite sequence of switches 74 and then 72, as the segment 66 passes in the counterclockwise direction. These pulses can be used to cause the liquid crystal display 56 mounted in dial ring assembly 10 to be incremented or de-incremented in relation to the pulse count and direction.

If GMR devices are used, appropriate voltage sensing circuitry must be included in the circuitry to detect the change in resistance and provide digital output to the microprocessor 80. Such circuitry is typically provided in integrated GMR sensors.

In FIG. 5, the system printed circuit card 20 is shown mounted to the back cover assembly 70. The back cover assembly 70 is typically mounted to the lock case 76 with two screws, not shown. Whenever assembly 70 is mounted to the lock case 76, proper spacing is achieved to allow the reed switches 72 and 74 to be closed and opened alternately by the alternating magnetic segments 62 and nonmagnetic segments 64 of the circular flat magnet 60, as the drive cam 38 is rotated by the inner dial assembly 32. These pulses are used by the microprocessor 80 to control the number to be displayed on the liquid crystal display (LCD) 56, mounted in the dial ring 10 via cable 22 through the tubes 82 and 84.

The manual operation of the lock disclosed herein is accomplished by the operator grasping the outer dial 28 and rotating the outer dial 28 either clockwise, counterclockwise, or both. In fact, the outer dial 28 may be grasped by the operator and oscillated first in one direction, then the other. By so doing, the magnetic rings 24 and 26 are moved past the wire coils 16 thus causing the magnetic field force lines extending from the inner magnetic ring 26 to the outer magnetic ring 24 to be cut by the coils as they pass the coils 16. As the magnetic fields pass the coils 16, electrical power is generated. As that power is generated, it is conducted through the rectifier circuit 18 illustrated in FIG. 3. From the rectifier circuit 18 the power, now in direct current form, is conveyed to the electronic control board 20. As the power is stored in a super capacitor 86 mounted on the electronic control circuit board 20, the super capacitor 86 then provides the energy to permit the microprocessor 80 to be powered and function. When the power level in the capacitor 86 reaches a threshold, that threshold is detected by the micro-processor 80 and the electronics begin to function as the microprocessor 80 powers up and begins its power-on routines. After the microprocessor 80 is powered up, the liquid crystal display 56 at the top of the dial ring housing 10 will display appropriate symbols and numbers for the entry of a combination as well as provide other data for initialization or other lock functions.

Once the LCD 56 becomes active and begins to display appropriate characters to prompt the operator to enter the combination or perform some other data entry, the inner dial 32 may be rotated manually to provide data input. The rotation of the inner dial 32 rotates spindle 40, which in turn drives the cam wheel 38 and drive cam ring magnet 60. The gear teeth 68 on the periphery of drive cam 60 will mesh with a properly positioned stepper motor gear 88 to drive a mechanical chain of parts (not shown) to open the lock.

The generator disclosed herein provides a simpler, more reliable approach to power generation for self-powered electronic combination locks.

One skilled in the art will recognize that minor changes and alterations to the disclosed structure may be made without removing the device from the scope of protection provided by the appended claims.

I claim:

1. An electronic combination lock comprising:

a lock housing containing a mechanical lock mechanism;

electronic controls for said mechanical lock mechanism;

a dial for manual rotation to input a combination to said lock electronic controls;

a dial housing surrounding at least a portion of said dial;

a generator disposed within and operable by rotation of said dial housing and having at least a first ring of magnetic segments proximate at least one coil of wire;

a second ring of magnetic segments adapted to rotate with said dial;

said at least one coil of wire disposed to remain stationary relative to said dial housing, said coil of wire electrically connected to said electronic controls;

whereby said at least a first ring of magnetic segments is rotated by rotation of said dial housing, thereby generating electrical power for use by said electronic controls.

2. The electronic combination lock of claim 1 wherein said at least one coil of wire is a plurality of coils of wire disposed about an axis of rotation of said first ring of magnetic segments.

3. The electronic combination lock of claim 1 wherein said at least a first ring of magnetic segments comprises a pair of concentric rings of magnetic segments spaced radially from each other and forming a spatial region for accepting in said spacial region said at least one coil.

4. The electronic combination lock of claim 1 wherein said at least a first ring of magnetic segments is rotatable past said coil, passing magnetic force fields of said magnetic segments past said coil and thereby generating electrical energy.

5. The electronic combination lock of claim 1 wherein said at least a first ring of magnetic segments is formed of a plurality of oppositely oriented segments alternated about said first ring.

6. The electronic combination lock of claim 1 wherein said pair of rings of magnetic segments are disposed with oppositely oriented magnetic segments are radically aligned and pass on opposite sides of said at least on coil of wire.

7. The electronic combination lock of claim 6 wherein said pair of rings are disposed on and attached to said dial for rotation therewith.

* * * * *